US010549339B2

(12) United States Patent
Wang et al.

(10) Patent No.: US 10,549,339 B2
(45) Date of Patent: Feb. 4, 2020

(54) LOW-PRESSURE CASTING MOLD FOR ALUMINUM WHEEL

(71) Applicant: CITIC Dicastal CO., LTD, Qinhuangdao (CN)

(72) Inventors: Kaiqing Wang, Qinhuangdao (CN); Song Sheng, Qinhuangdao (CN); Yingfeng Wang, Qinhuangdao (CN); Xianyi Xu, Qinhuangdao (CN); Changhai Li, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 58 days.

(21) Appl. No.: 16/050,097

(22) Filed: Jul. 31, 2018

(65) Prior Publication Data

US 2019/0299276 A1 Oct. 3, 2019

(30) Foreign Application Priority Data

Mar. 30, 2018 (CN) ..... 2018 1 0156690

(51) Int. Cl.

| | |
|---|---|
| ***B22C 9/28*** | (2006.01) |
| ***B22C 9/06*** | (2006.01) |
| ***B22D 18/04*** | (2006.01) |
| ***B22D 15/00*** | (2006.01) |

(52) U.S. Cl.

CPC ..... *B22C 9/28* (2013.01); *B22C 9/065* (2013.01); *B22D 15/005* (2013.01); *B22D 18/04* (2013.01)

(58) Field of Classification Search

CPC ..... B22C 9/065; B22C 9/28; B22D 18/04

See application file for complete search history.

(56) References Cited

U.S. PATENT DOCUMENTS

2018/0264541 A1* 9/2018 Wang ..... B22C 9/28

FOREIGN PATENT DOCUMENTS

| | | |
|---|---|---|
| CN | 203281820 U | 11/2013 |
| CN | 103586438 A | 2/2014 |
| CN | 205702394 U | 11/2016 |

* cited by examiner

*Primary Examiner* — Kevin E Yoon

(74) *Attorney, Agent, or Firm* — Calfee, Halter & Griswold LLP

(57) ABSTRACT

Disclosed in the present application is a low-pressure casting mold for an aluminum wheel. V-shaped grooves are formed in the cavity surface of a side mold, a cavity is formed in the back cavity of the side mold, a cooling duct is arranged in the cavity of the side mold, and a main air pipe is perpendicular to an annular branch; the annular branch is concentric with a wheel casting, and air pipes are 5-10 mm away from the bottom surface of the cavity; the two ends of the annular branch are welded with plugs; air outlet holes are arranged on the annular branch, and the holes are perpendicular to the bottom surface of the cavity; the diameters of the air outlet holes are 3 mm, and the holes are uniformly distributed at intervals of 10-15 mm in the circumferential direction.

1 Claim, 3 Drawing Sheets

LOW-PRESSURE CASTING MOLD FOR ALUMINUM WHEEL

CROSS-REFERENCE TO RELATED APPLICATIONS

This application claims priority to Chinese Patent Application No. 201810156690.8 filed on Mar. 30, 2018, which is hereby incorporated by reference in its entirety.

TECHNICAL FIELD

The present application relates to the field of casting, specifically to a low-pressure casting mold intended to eliminate the shrinkage defect of hump hot spots of an aluminum wheel.

BACKGROUND ART

In the low-pressure casting production of an aluminum wheel, the hump (area A in FIG. 1) at the inner rim is thick, has obvious hot spots, and is a common part of casting defects. The hump is at the distal end for mold filling. When molten aluminum flows to the hump, its temperature has decreased so much that the shrinkage defect occurs due to insufficient feeding capacity of the front end. The casting structure at this part is relatively thick and is located between the inner rim and the rim. It is often impossible to directly implement effective cooling to a mold, resulting in the accumulation of heat, slow solidification of the molten aluminum, coarse crystal grains in the casting, and low mechanical properties. In actual production, the large proportion of waste products caused by unqualified casting of humps has seriously affected the molding quality of the wheels and reduced the success rate of samples delivered to customers.

SUMMARY OF THE INVENTION

The object of the present application is to overcome the defects of the prior art and provide a low-pressure casting mold for an aluminum wheel, which may effectively eliminate hump hot spots and overcome the defect of shrinkage inside a casting by strengthening local cooling, and may improve the mechanical properties of the wheel by thinning a grain structure to meet customer's quality requirements.

A low-pressure casting mold for an aluminum wheel includes a bottom mold, a sprue cup, a sprue bushing, a filter screen, a sprue spreader, a side mold, a top mold and a cooling duct, wherein the top mold, the bottom mold and the side mold together constitute a mold cavity of the mold to ensure smooth molding of a wheel casting.

For a hump, V-shaped grooves are formed in the cavity surface of the side mold, are designed to follow the contour of the hump, and cover the whole hot spot area in the length direction; the depths of the V-shaped grooves are 1-1.5 mm, the included angles are 60-120°, and the V-shaped grooves are uniformly distributed on the circumference of the side mold at intervals of 10 mm.

In the back cavity of the side mold, a cavity is formed opposite to the hump, and is concentric with the wheel casting and annular; the bottom surface of the cavity is designed to follow the contour of the hump, and is 8-12 mm away from the wall of the mold cavity; the height of the cavity is equivalent to the range of hump hot spots; safety wall thicknesses of at least 10 mm are reserved between the two side surfaces of the cavity and the fitting surfaces of the side mold to ensure the use strength of the mold.

The cooling duct is made of stainless steel pipes, and includes a main air pipe and an annular branch; the main air pipe is perpendicular to the annular branch, and is designed in a single inlet form; the annular branch is designed concentric with the wheel casting, and the main air pipe is 5-10 mm away from the bottom surface of the cavity; the two ends of the annular branch need to be welded to form plugs to form a closed duct; air outlet holes are machined on the annular branch, and the air outlet holes are perpendicular to the bottom surface of the cavity; the diameters of the air outlet holes are designed to 3 mm, and the air outlet holes are uniformly distributed at intervals of 10-15 mm in the circumferential direction; when cooling begins, compressed air acts on the surface of the mold through the air outlet holes and quickly takes the accumulated heat away, thereby realizing cooling and solidification of the casting.

The fabricated cooling duct is installed into the cavity of the side mold and fixed by welding or bolting to ensure smooth operation. When filling begins 20-30 s, cooling of the hump begins and stops after the inner rim is completely solidified, the flow rate is usually controlled at 40-80 $m^3/h$, the operation is circulated according to this process parameter, and continuous and stable production of the hump hot spot position without defects may be achieved.

The present application is simple in structure and easy to implement: for the hump, grooves are designed in the cavity surface of the side mold to enlarge the heat dissipation area of the mold and improve the natural cooling capacity of the mold; the cooling cavity is machined in the back cavity of the side mold and the cooling duct is installed on the cooling cavity to realize centralized cooling of hot spots, thereby realizing rapid heat output, improving the solidification rate of molten aluminum, ensuring effective feeding, and better overcoming the defects of shrinkage, grain coarseness and the like that easily occur in the casting; and at the same time, the comprehensive mechanical properties of the product are improved, and the safety index of the wheel is also greatly improved.

Figure 1:
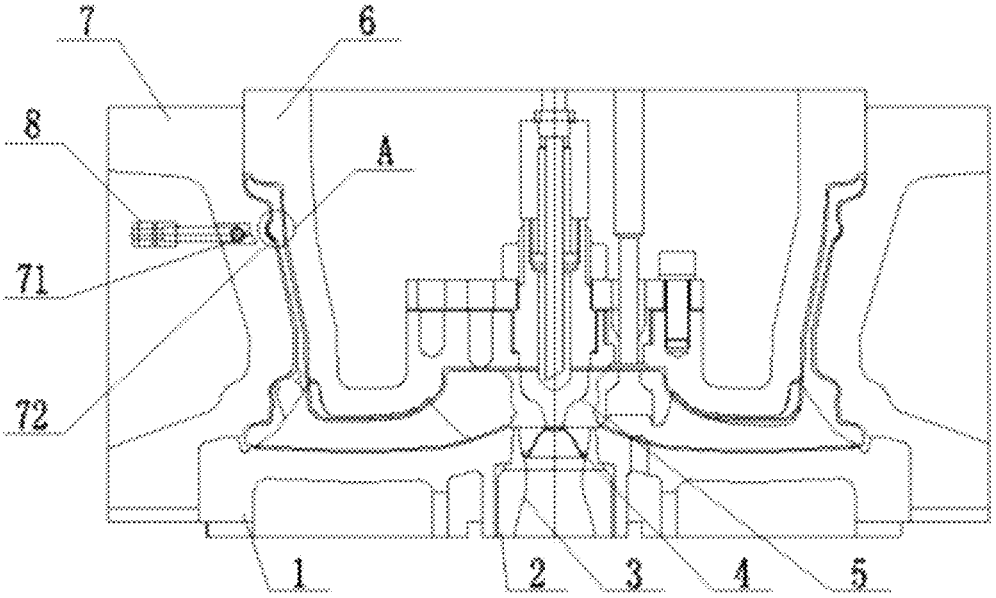
FIG. 1 is an assembly diagram of a low-pressure casting mold for a wheel according to the present application.
Figure 2:
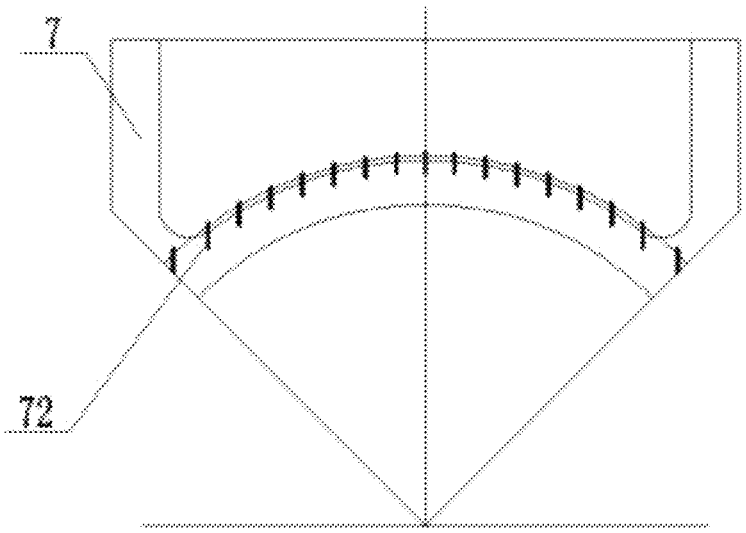
FIG. 2 is a schematic diagram of an arrangement of cooling grooves in a side mold according to the present application.
Figure 3:
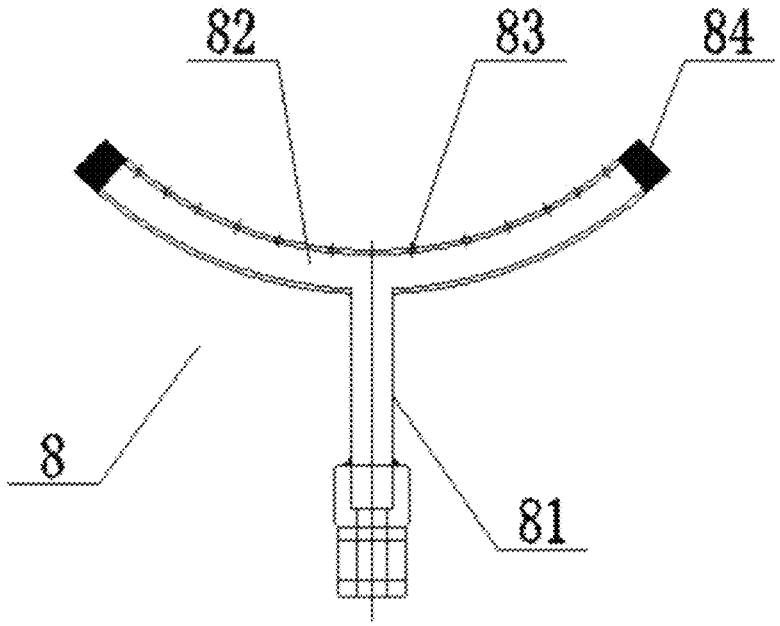
FIG. 3 is a structure diagram of a cooling duct in the side mold according to the present application.

In which: A—hump, 1—bottom mold, 2—sprue cup, 3—sprue bushing, 4—filter screen, 5—sprue spreader, 6—top mold, 7—side mold, 71—cavity, 72—V-shaped groove, 8—cooling duct, 81—main air pipe, 82—annular branch, 83—air outlet hole, 84—plug.

DETAILED DESCRIPTION OF THE INVENTION

The details and working conditions of the specific device proposed by the present application will be described below in combination with the accompanying drawings.

A low-pressure casting mold for an aluminum wheel includes a bottom mold 1, a sprue cup 2, a sprue bushing 3, a filter screen 4, a sprue spreader 5, a top mold 6, a side mold 7 and a cooling duct 8, wherein the bottom mold 1, the top mold 6 and the side mold 7 together constitute a mold cavity of the mold to ensure smooth molding of a wheel casting.

The low-pressure casting of the aluminum wheel belongs to bottom center casting. The sprue cup 2, the sprue bushing 3 and the filter mesh 4 constitute a main casting system, and are installed in a center hole of the bottom mold 1. When high-temperature molten aluminum enters the cavity, the mold is filled stably, uniformly and smoothly under the guidance of the sprue spreader 5 to ensure a well solidification and crystallization process of the casting later.

For a hump A, V-shaped grooves 72 are machined in the cavity surface of the side mold 7, are designed to follow the contour of the hump A, and cover the whole hot spot area in the length direction; the depths of the V-shaped grooves 72 are 1-1.5 mm, the included angles are 60-120°, and the V-shaped grooves 72 are uniformly distributed on the circumference of the side mold 7 at intervals of 10 mm; and the grooves 72 need to be numerically milled on a machine tool in order to ensure the fabricating precision and avoid sticking aluminum.

In the back cavity of the side mold 7, a cavity 71 is machined opposite to the hump A, and is concentric with the wheel casting and annular; the bottom surface of the cavity 71 is designed to follow the contour of the hump A, and is 8-12 mm away from the wall of the mold cavity; the height of the cavity 71 is equivalent to the range of hump hot spots; safety wall thicknesses of at least 10 mm are reserved between the two side surfaces of the cavity 71 and the fitting surfaces of the side mold 7 to ensure the use strength of the mold.

The cooling duct 8 is made of stainless steel pipes, and includes a main air pipe 81 and an annular branch 82; the main air pipe 81 is perpendicular to the annular branch 82, and is designed in a single inlet form; the annular branch 82 is designed concentric with the wheel casting, and the main air pipe is 5-10 mm away from the bottom surface of the cavity; the two ends of the annular branch 82 need to be welded with plugs 84 to form a closed duct; air outlet holes 83 are machined on the annular branch 82, and the air outlet holes 83 are perpendicular to the bottom surface of the cavity; the diameters of the air outlet holes 83 are designed to 3 mm, and the air outlet holes 83 are uniformly distributed at intervals of 10-15 mm in the circumferential direction; when cooling begins, compressed air acts on the surface of the mold through the air outlet holes 83 and quickly takes the accumulated heat away, thereby realizing cooling and solidification of the casting.

The fabricated cooling duct 8 is installed into the cavity 71 of the side mold 7 and fixed by welding or bolting to ensure smooth operation. When filling begins 20-30 s, cooling of the hump A begins and stops after the inner rim is completely solidified, the flow rate is usually controlled at 40-80 $m^3/h$, the operation is circulated according to this process parameter, and continuous and stable production of the hump hot spot position without defects may be achieved.

The present application is simple in structure and easy to implement: for the hump, grooves are designed in the cavity surface of the side mold to enlarge the heat dissipation area of the mold and improve the natural cooling capacity of the mold; the cooling cavity is machined in the back cavity of the side mold and the cooling duct is installed on the cooling cavity to realize centralized cooling of hot spots, thereby realizing rapid heat output, improving the solidification rate of molten aluminum, ensuring effective feeding, and better overcoming the defects of shrinkage, grain coarseness and the like that easily occur in the casting; and at the same time, the comprehensive mechanical properties of the product are improved, and the safety index of the wheel is also greatly improved.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A low-pressure casting mold for an aluminum wheel, comprising a bottom mold, a sprue cup, a sprue bushing, a filter screen, a sprue spreader, a top mold, a side mold and a cooling duct, wherein in a cavity surface of the side mold, V-shaped grooves are formed opposite to a hump, follow the contour of the hump, and cover a whole hot spot area in a length direction; depths of the V-shaped grooves are 1-1.5 mm, included angles are 60-120°, and the V-shaped grooves are uniformly distributed on the circumference of the side mold at intervals of 10 mm;

in a back cavity of the side mold, a cavity is formed opposite to the hump, and is concentric with a wheel casting and annular; a bottom surface of the cavity follows the contour of the hump, and is 8-12 mm away from a wall of a mold cavity; a height of the cavity is equivalent to the range of hump hot spots; the two side surfaces of the cavity are at least 10 mm away from fitting surfaces of the side mold;

the cooling duct is arranged in the cavity of the side mold, and comprises a main air pipe and an annular branch; the main air pipe is perpendicular to the annular branch, and is in a single inlet form; the annular branch is concentric with the wheel casting, and the main air pipe is 5-10 mm away from the bottom surface of the cavity; two ends of the annular branch are welded to form plugs to form a closed duct; air outlet holes are arranged on the annular branch, and the air outlet holes are perpendicular to the bottom surface of the cavity; the diameters of the air outlet holes are 3 mm, and the holes are uniformly distributed at intervals of 10-15 mm in the circumferential direction.

* * * * *